US006593836B1

(12) United States Patent
LaFleur et al.

(10) Patent No.: US 6,593,836 B1
(45) Date of Patent: Jul. 15, 2003

(54) BOBBINS, TRANSFORMERS, MAGNETIC COMPONENTS, AND METHODS

(75) Inventors: Michael B. LaFleur, East Hampstead, NH (US); Patrizio Vinciarelli, Boston, MA (US)

(73) Assignee: VLT Corporation, San Antonio, TX (US)

( * ) Notice: Subject to any disclaimer, the term of this patent is extended or adjusted under 35 U.S.C. 154(b) by 0 days.

(21) Appl. No.: 09/342,403

(22) Filed: Jun. 28, 1999

Related U.S. Application Data

(63) Continuation-in-part of application No. 09/184,461, filed on Oct. 20, 1998.

(51) Int. Cl.[7] ..... H01F 27/08

(52) U.S. Cl. ..... 336/61; 336/84 R; 336/198; 336/212; 336/219

(58) Field of Search ..... 336/55, 61, 182, 336/184, 194, 220, 87, 65, 178, 208, 192, 198, 212, 219, 84 M, 84 C, 84 R

(56) References Cited

U.S. PATENT DOCUMENTS 4,441,146 A 4/1984 Vinciarelli
4,507,975 A 4/1985 Bittner et al.
5,420,559 A 5/1995 Ohshiba et al.
5,546,065 A * 8/1996 Vinciarelli et al. ..... 336/84
5,719,544 A 2/1998 Vinciarelli et al.
5,959,521 A * 9/1999 Kohmura et al. ..... 336/198
6,092,557 A 7/2000 Sumner

FOREIGN PATENT DOCUMENTS

JP 5-205953 * 8/1993

OTHER PUBLICATIONS

Andrus et al., USSN 08/941,219 "Plating Permeable Cores" filed Oct. 1, 1997.

* cited by examiner

*Primary Examiner*—Tuyen T. Nguyen
(74) *Attorney, Agent, or Firm*—Fish & Richardson P.C.

(57) ABSTRACT

A bobbin is adapted to support a winding on a permeable core and has a wall that provides a confined thermally conductive channel that causes conduction of heat along a predetermined path from the core to a location outside the winding. A value of magnetizing inductance in a transformer is set by adjusting the gap until the value of magnetizing inductance has been set and attaching a segment of the bobbin to a pair of core pieces to maintain the gap. A permeable strip provides a permeable path outside of the hollow interior space and does not couple the winding, and an electrically insulating coupler is interposed between the slug and the winding to electrically insulate the winding.

46 Claims, 15 Drawing Sheets

BOBBINS, TRANSFORMERS, MAGNETIC COMPONENTS, AND METHODS

BACKGROUND OF THE INVENTION

This is a continuation-in-part of U.S. patent application Ser. No. 09/184,461, filed Oct. 20, 1998, and incorporated by reference.

This invention relates to bobbins, transformers, magnetic components, and methods.

FIGS. 1A and 1B show, respectively, a top and side view of a transformer 10 of the kind described in U.S. Pat. No. 5,719,544 ("Transformer With Controlled Interwinding Coupling and Controlled Leakage Inductances and Circuit Using Such Transformer," Vinciarelli et al., assigned to the same assignee as this application and incorporated herein by reference, the "transformer patent"). The transformer comprises two bobbin assemblies 1A, 1B, each comprising an electrically conductive winding 2A, 2B wound over a non-conductive bobbin 4A, 4B. The two windings are linked by a magnetic medium comprising two core assemblies 11. Each core assembly comprises an electrically conductive medium 12 selectively arranged over the surface of a permeable core piece 6 (e.g., by means of plating—see, for example, U.S. patent application Ser. No. 08/941,219 filed on Oct. 1, 1997—or use of formed sheets or foils). The faces 8 of the core pieces 6 are free of conductive medium and a slit is provided along the inner periphery of the core assemblies (not shown), thereby preventing formation of a "shorted turn." The conductive medium 12 constrains the transformer leakage flux to lie within the region confined by the conductive medium. As discussed in the transformer patent, such a transformer has a number of benefits: it exhibits much lower leakage inductance than similar transformers without a conductive medium; the widely separated windings exhibit low interwinding capacitances; the placement of the windings provides for easy removal of heat; and many different transformers, varying in terms of turns ratio and leakage inductance, may be inductance of the transformer may be set by means of a gap 16 in the magnetic path (a portion of the bobbin 4B and winding 2B are shown cut away to show the gap).

In other transformer embodiments, described in the transformer patent and shown in FIG. 2, extensions 20 of the permeable magnetic material may be used to provide a low reluctance path for leakage flux 21 in the region between the core halves, thereby providing a greater possible range of leakage inductance. Such extensions 20 may also be covered with a conductive medium.

As shown in FIG. 3, a saturable inductor 22 is sometimes placed in series with a winding 26 of a transformer 24 in a switching power supply. In some applications, the saturable inductor is used to limit rectifier 32, 33 reverse recovery currents and attendant conducted and radiated noise. Such an inductor may also be used in a converter comprising an "active clamp" core resetting circuit 30 (of the kind described in U.S. Pat No. 4,441,146, "Optimal Resetting of the Transformer's Core in Single-Ended Forward Converter, Vinciarelli, assigned to the same assignee as this application, incorporated by reference) to provide a high impedance load on the transformer winding for a short time following turn-on of the main switch 28, thereby allowing the "mirrored" flow of transformer magnetizing current to more fully charge and discharge parasitic capacitances than would otherwise be possible without it and allow for zero-voltage switching operation. The number of turns on the saturable inductor 22 will depend on the required "volt-second" rating and will, for a given transformer configuration, vary as a function of the output voltage of the converter. To maintain a fixed "time to saturation", the number of turns on a saturable inductor will, for a given saturable core, need to increase in proportion to transformer output voltage. Thus, different saturable inductors are generally required for different output voltage settings.

Summary

In general, in another aspect, the invention features a leakage inductance transformer that includes a bobbin, a winding surrounding the bobbin, a permeable magnetic core having a magnetically permeable segment which passes within the bobbin to form a flux path that couples the winding, and a permeable magnetic insert that is located outside of a hollow interior space enclosed by the bobbin.

Implementations of the invention may include one or more of the following features. The bobbin may have an electrically insulating wall surrounding a hollow interior space, the electrically insulating wall including segments having different thermal conductivities to provide the confined thermally conductive channel. The confined thermally conductive channel may be provided by ceramic (e.g., alumina). One of the segments may be plastic. A solderable metal coating of the bobbin may provide the confined thermally conductive channel and may be attached to the permeable core. The confined thermally conductive channel may have a thermal conductivity greater than 1 BTU/(hourxfootxdeg.F) while another segment of the bobbin may have a thermal conductivity less than 1 BTU/(hourxfootxdeg.F)).

A magnetically permeable insert strip of amorphous magnetic material may be located outside of a hollow interior space enclosed by the bobbin. The insert may lie in a flux path defined by, and be permeably linked to, the leakage lug. The insert may be a saturable magnetic material. The insert may lie in a plane perpendicular to the thermally conductive wall of the bobbin.

Other advantages and features will become apparent from the following description and from the claims.

BRIEF DESCRIPTION OF THE DRAWINGS

Among the benefits provided by the transformer structure 10 of FIGS. 1 and 2 are reduced interwinding capacitances and ease of removal of heat from the windings owing to the placement of the windings on the exterior of the structure. However, a drawback of the structure is that the bobbins 4A, 4B, which provide electrical insulation between the windings and the cores and which are typically fabricated from materials which exhibit low electrical and thermal conductivity (e.g., plastic), cover portions of the surface area of the core assemblies 11, thereby interfering with removal of heat from the cores assemblies themselves. As shown in FIG. 4, one way to aid in the removal of heat from the core of a transformer having thermally insulating bobbins is to fasten thermally conductive "core coolers" 15 to the ends of the core assemblies 11. Heat generated in the cores is conducted by the core coolers to a heat sinking surface 34. In one example, the core coolers are fabricated from copper and are soldered to both the conductive shields (12, FIG. 1) and to a heat sink 34.

Figure 5:
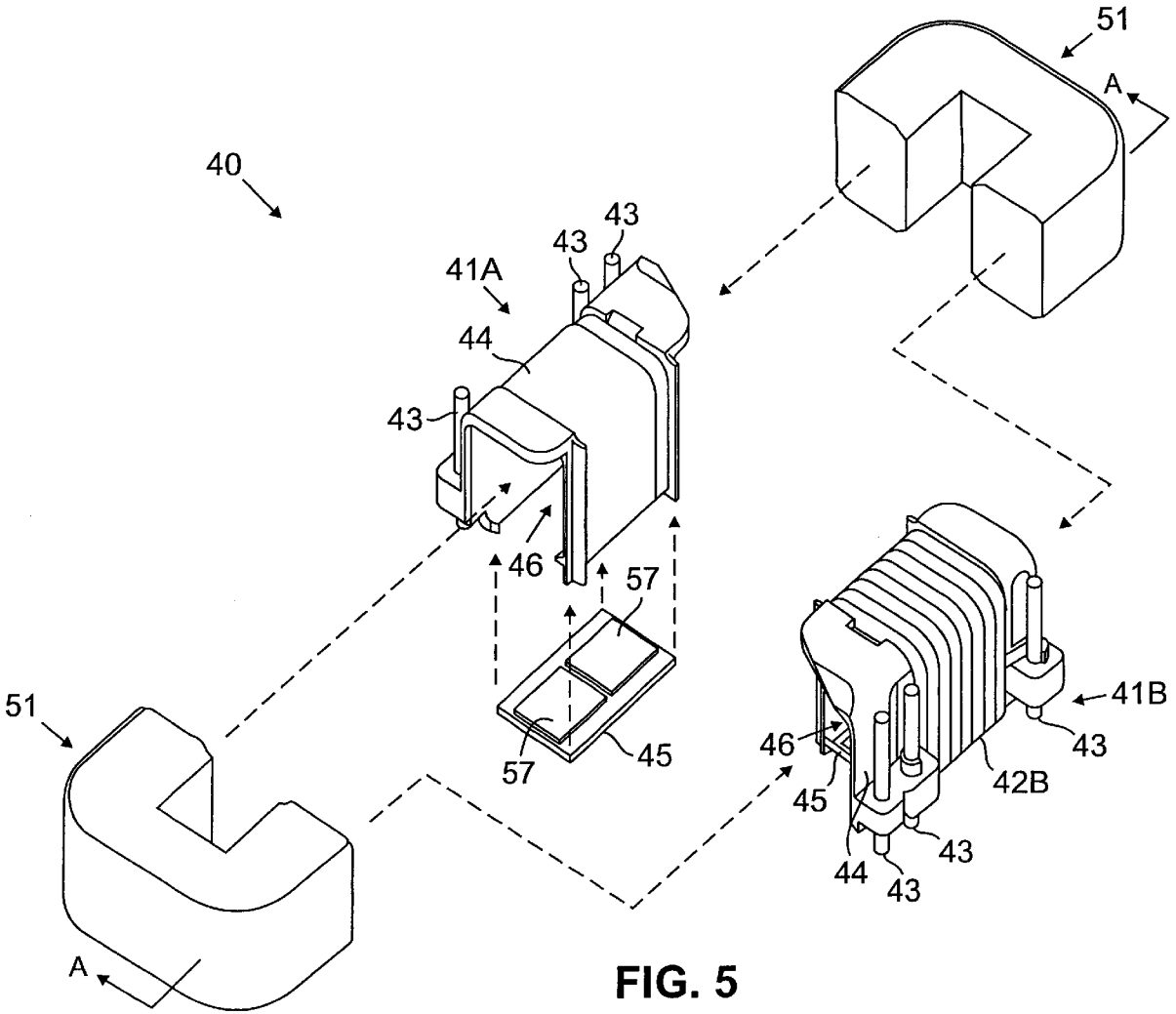
FIG. 5 shows a transformer with composite bobbins.

In the example shown in FIG. 5, the transformer 40 comprises two core assemblies 51 and two composite bobbin assemblies 41A, 41B. Each of the composite bobbin assemblies comprise a formed segment 44, a winding (only one such winding 42B is shown) and a thermally conductive segment 45. In one example, the formed segment is molded from electrically non-conductive plastic and the thermally conductive segment is made from a 0.26"×0.575"×0.020" flat piece of alumina ceramic, which is thermally conductive but electrically non-conductive. As shown in the Figure, the thermally conductive segment is attached to the formed segment to create a hollow composite bobbin assembly 41A, 41B around which a winding 42B can be wound. Conductive pins 43 are provided for terminating windings and for connecting the windings to external circuitry.

The transformer 40 is assembled by first selecting composite bobbins having desired numbers of turns and a pair of core assemblies 51. As shown in the sectioned side view of FIG. 6 (section A—A, FIG. 5), the core assemblies 51 are inserted into the open ends (e.g., open ends 46, FIG. 5) of the hollow composite bobbin assemblies 41A, 41B and attached to the surface of the thermally conductive segments 45 using a bonding medium 49. The bonding medium 49 can be epoxy. The bonding medium is preferably a material which is flexible when applied and which requires a processing step, such as heating, to form a bond. This provides for relatively rapid formation of the bond once assembly is complete, while eliminating the problem of having the bond form during assembly. Thermally setting epoxies and solder paste are examples of such bonding mediums. Solder can be used as the bonding medium if the core assemblies comprise a conductive shield at least in the region which is adjacent to the thermally conductive segment and if solderable pads (57, FIG. 5) are provided on the surface of the thermally conductive segment 45 (e.g. 0.5 milli-inch thick pads of palladium silver copper pads 57 deposited on the surface of a piece of alumina ceramic). This is shown in cross-section in FIG. 7, in which solder 49 connects solderable pads 57 to the conductive coatings 12 on core pieces 6.

Figure 4:
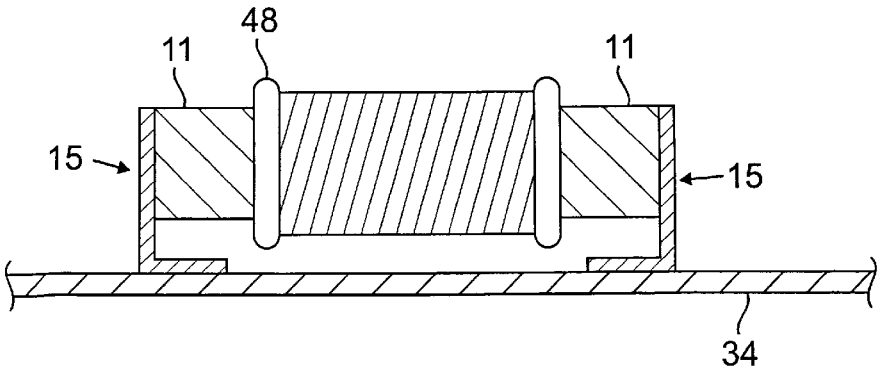
FIG. 4 shows a transformer connected to a heat sink by means of core coolers.
Figure 6:
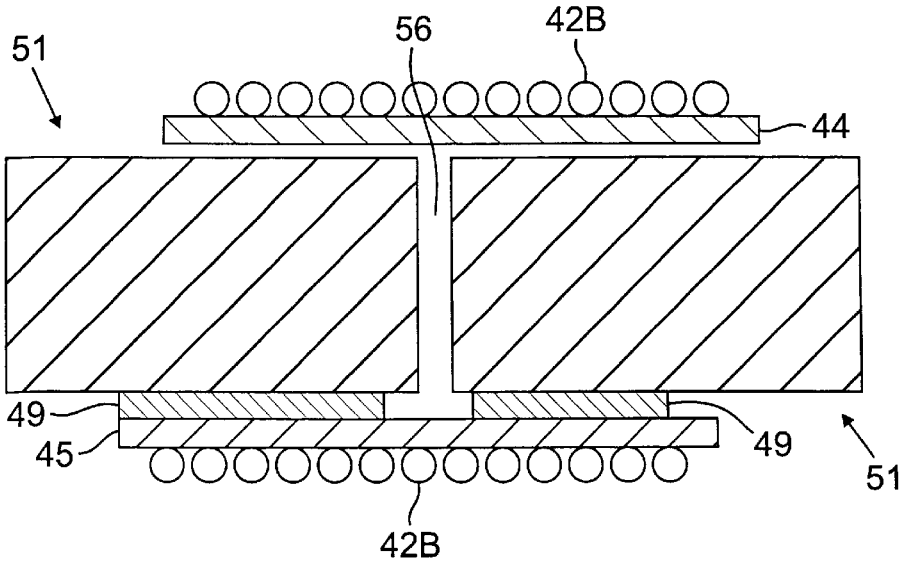
FIG. 6 shows a sectioned view of a transformer.
Figure 7:
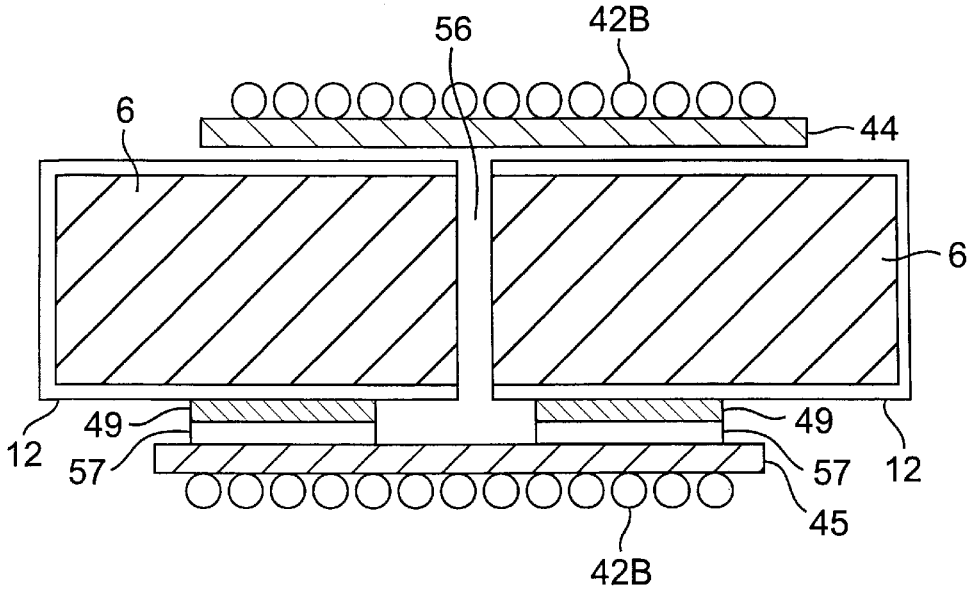
FIG. 7 shows a sectioned view of a transformer.
Figure 8:
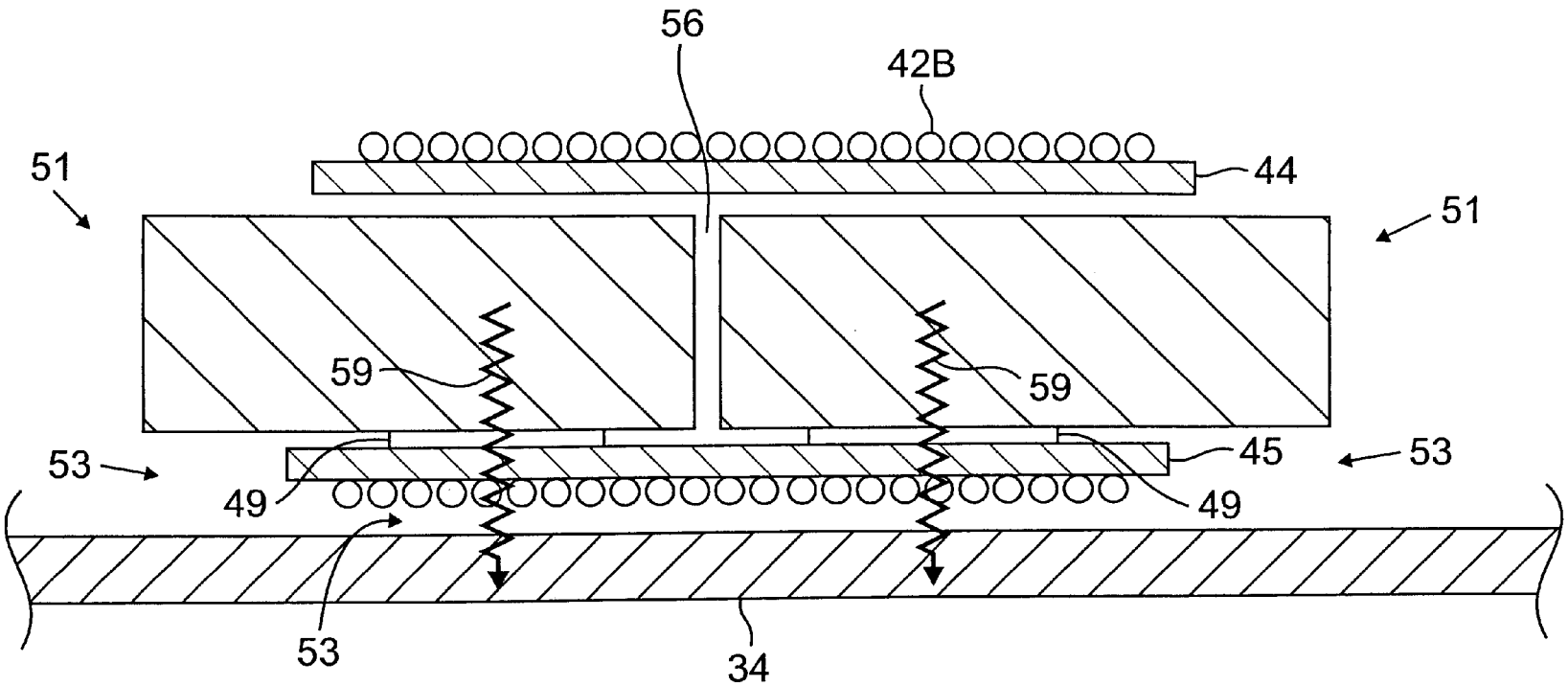
FIG. 8 shows a transformer in proximity to a heat sinking surface.

As shown in FIG. 8, when a transformer of the kind shown in FIGS. 5–8 is placed in proximity to a heat sinking surface 34 (a thermally conductive encapsulating material is presumed to fill the regions 53 between the transformer and the heat sink 34), the material in the bobbin does not create a high impedance thermal path between the core pieces 51 and the heat sink. Rather, the bonding medium 49 and the thermally conductive segment 45 form relatively low thermal impedance paths 59 between the core assemblies 51 and the heat sink 34. This allows for cooler operation of the cores whether or not core coolers (15, FIG. 4) are used. Solder is a preferred bonding medium 49 because of its high thermal conductivity and its ability to fill relatively thick gaps (e.g., 10 milli-inches) between the thermally conductive segment 45 and the core assembly 51. By using solderable pads 57 (FIGS. 5, 7) having relatively large surface areas, relatively low values of thermal impedance can be achieved.

The non-conductive wall of the bobbin has a segment having a relatively low thermal conductivity and a segment having a relatively high thermal conductivity. As used herein, the term "low thermal conductivity" will mean materials having a thermal conductivity less than 1 BTU/(HourxFootxdeg.F) and the term "high thermal conductivity" will mean materials having a thermal conductivity greater than or equal to 1 BTU/(HourxFootxdeg.F). For example, in some embodiments the formed segment 44 is molded from a PPS or LCP plastic, such as Vectra™ or Ryton™, which exhibit low thermal conductivities in the range of 0.12 to 0.17 BTU/(HourxFootxdeg.F), and the thermally conductive segment 45 is made of Alumina ceramic having a high thermal conductivity ranging from 8 to 12 BTU/(HourxFootxdeg.F).

Because the bonding medium forms a permanent bond between the core assemblies and the thermally conductive segment, the assemblies of FIGS. 5–7 provide an inherent means for accurately and permanently setting a gap 56 in the magnetic path (for setting, for example, a pre-determined value of magnetizing inductance). To accurately set the magnetizing inductance, the inductance of a transformer winding (e.g., winding 42B, FIG. 5) is measured while the gap 56 between the core assemblies 51 is adjusted. When the positioning of the core assemblies results in a pre-determined value of magnetizing inductance, insertion of the core assemblies is stopped. The bonding medium 49, which was placed on the surface of the thermally conductive segments 45 prior to insertion of the core assemblies, is then processed to create a bond. For example, if solder paste were used for the bonding medium, heat would be applied to the core pieces to melt the paste, which, upon cooling, would create a rigid solder bond between the core assemblies and the thermally conductive segment. A heat activated thermally conductive epoxy could be used in the same way.

Figure 9:
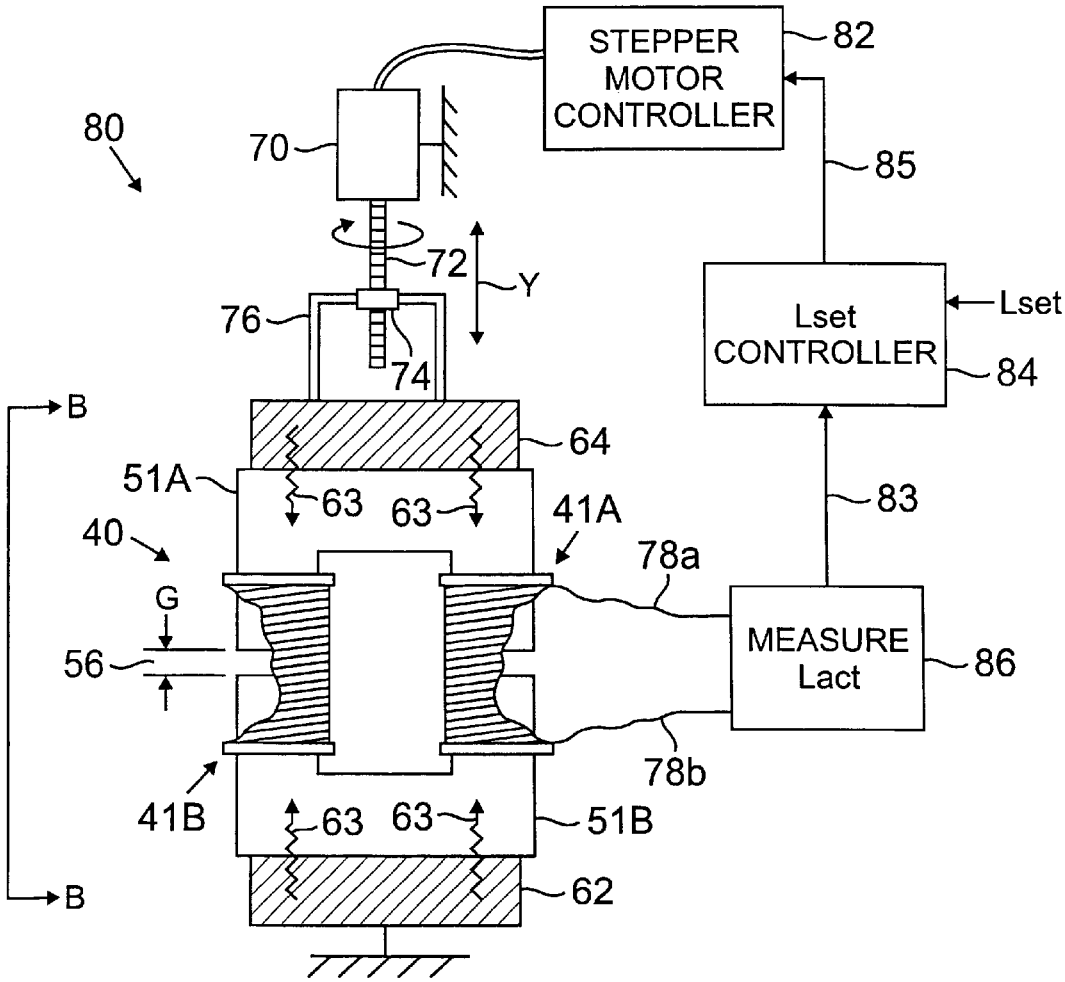
FIG. 9 shows apparatus for setting the magnetizing inductance of a transformer.

A system for accurately setting the gap is shown in FIG. 9. In the Figure a transformer 40 is held between two stops 62, 64. A first fixed stop 62 holds first core assembly 51B (e.g., by means of a vacuum, not shown); a second moveable stop 64 holds second core assembly 51A. The relative position of the first and second stops is adjusted by means of stepper motor 70. Rotation of the stepper motor shaft 72 is translated into linear motion of stop 64 (as indicated by the arrow marked "Y") by means of rollnut 74 and bracket 76. In operation a desired value of magnetizing inductance, Lset, is delivered to the Lset controller 84. Measurement device 86 delivers an actual value 83 of magnetizing inductance, Lact, to the Lset controller 84. The Lset controller compares the Lact to Lset, and, based on the difference, delivers information regarding motor speed and direction of rotation 85 to the stepper motor controller 82. If Lact is less than Lset, the motor will be driven in a rotational direction which decreases the gap 56. Should the gap be adjusted too far, causing Lact to be greater than Lset, the motor direction will be reversed and the gap increased. The motor can be operated at a fixed speed, or, to reduce setting time, motor speed may be decreased as Lact approaches Lset.

Once the gap 56 has been set to its final value, heat is applied to set the bonding medium, as described above (the thermally conductive segment and the bonding medium are not shown in FIG. 9). One way to apply heat, shown in FIG. 9, is to incorporate heating elements into the stops 62, 64. Heat is conducted from the heaters into the core assemblies and down into the region of the gap, as indicated by the arrows 63. If thermally setting epoxy is used as a bonding medium, the heat will cause the epoxy to set. If solder paste is used as bonding medium, and sufficient heat is applied for a sufficient period of time, the solder paste will melt, after which the heaters are turned off. The solder will harden on cooling. In either case the setting of the gap 56 will be permanently fixed by the bonding medium.

Figure 10A:
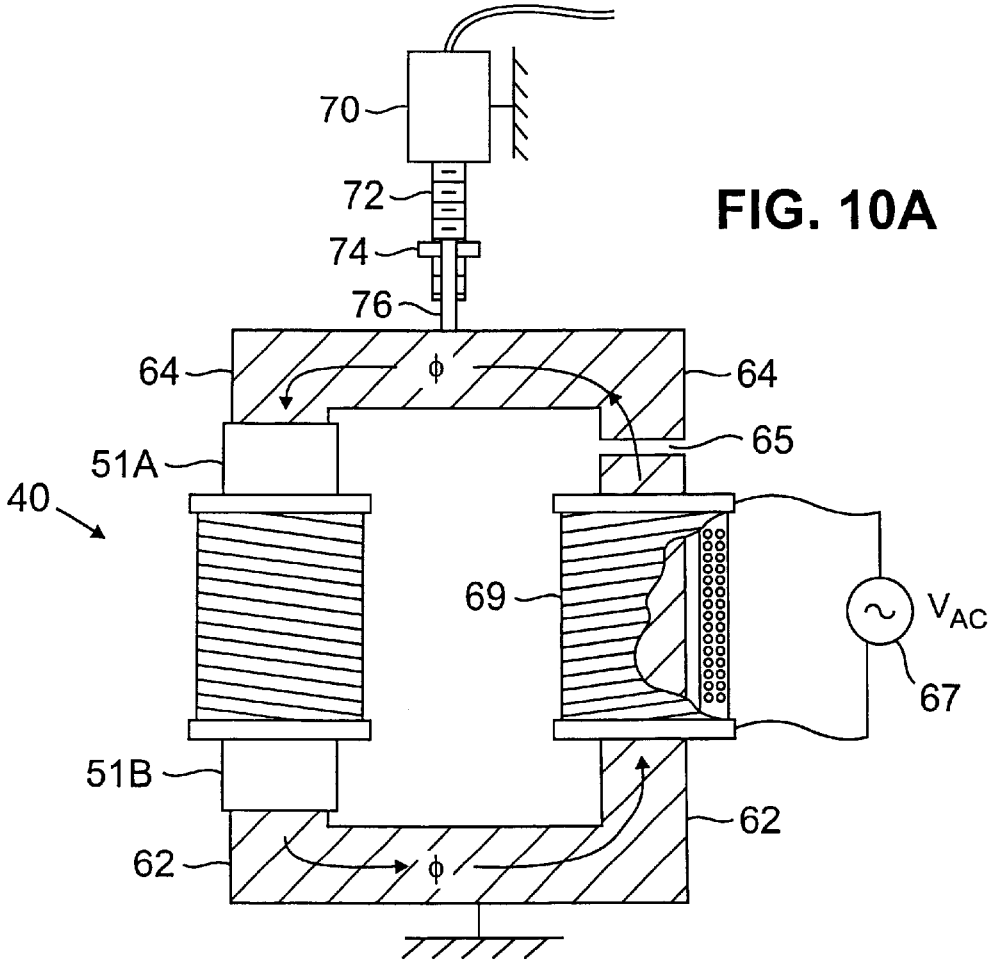
FIGS. 10A and 10B show apparatus for generating heat in a gapped magnetic structure.
Figure 10B:
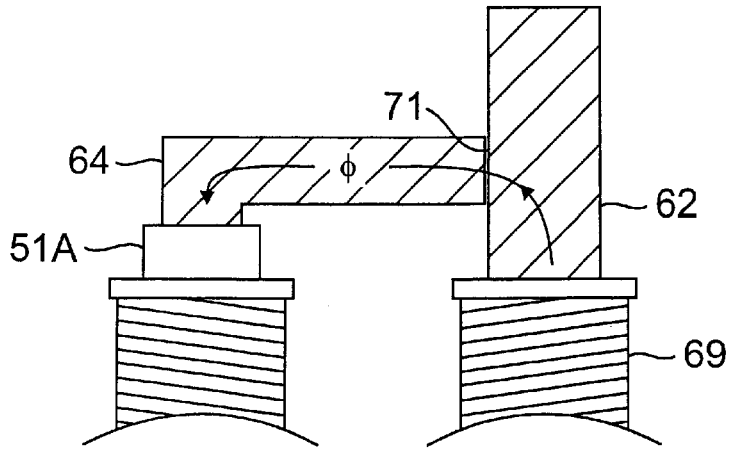

One way to provide heat in the region of the gap is shown in FIG. 10A, which shows a side view (view B—B, FIG. 9) of a portion of the apparatus of FIG. 9. In the Figures the stops 62, 64 are magnetically permeable elements which are part of a closed magnetic path which also comprises the core assemblies 51A, 51B, the gap 56 (FIG. 9) between the core faces, and a second gap 65. A winding 69, surrounding a portion of stop 62, is driven by an AC voltage source to induce an AC flux, $\phi$, in the magnetic path. Because the gaps represent high reluctance regions in the closed magnetic path, the AC flux causes selective heating in these regions. The second gap 65 provides for motion of stop 64 relative to stop 62. An alternative construction, shown in FIG. 10B, minimizes the effect of the variable second gap 65 by providing a region 71 in which an extension of stop 62 is in contact with, but not rigidly connected to, stop 64. This provides for motion of stop 64 relative to stop 62 while minimizing the non-variable gap in region 71.

Figure 2:
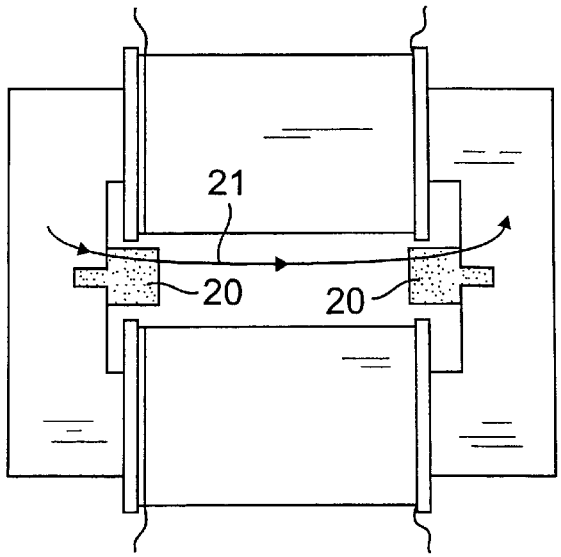
FIG. 2 shows a top view of a transformer.
Figure 11A:
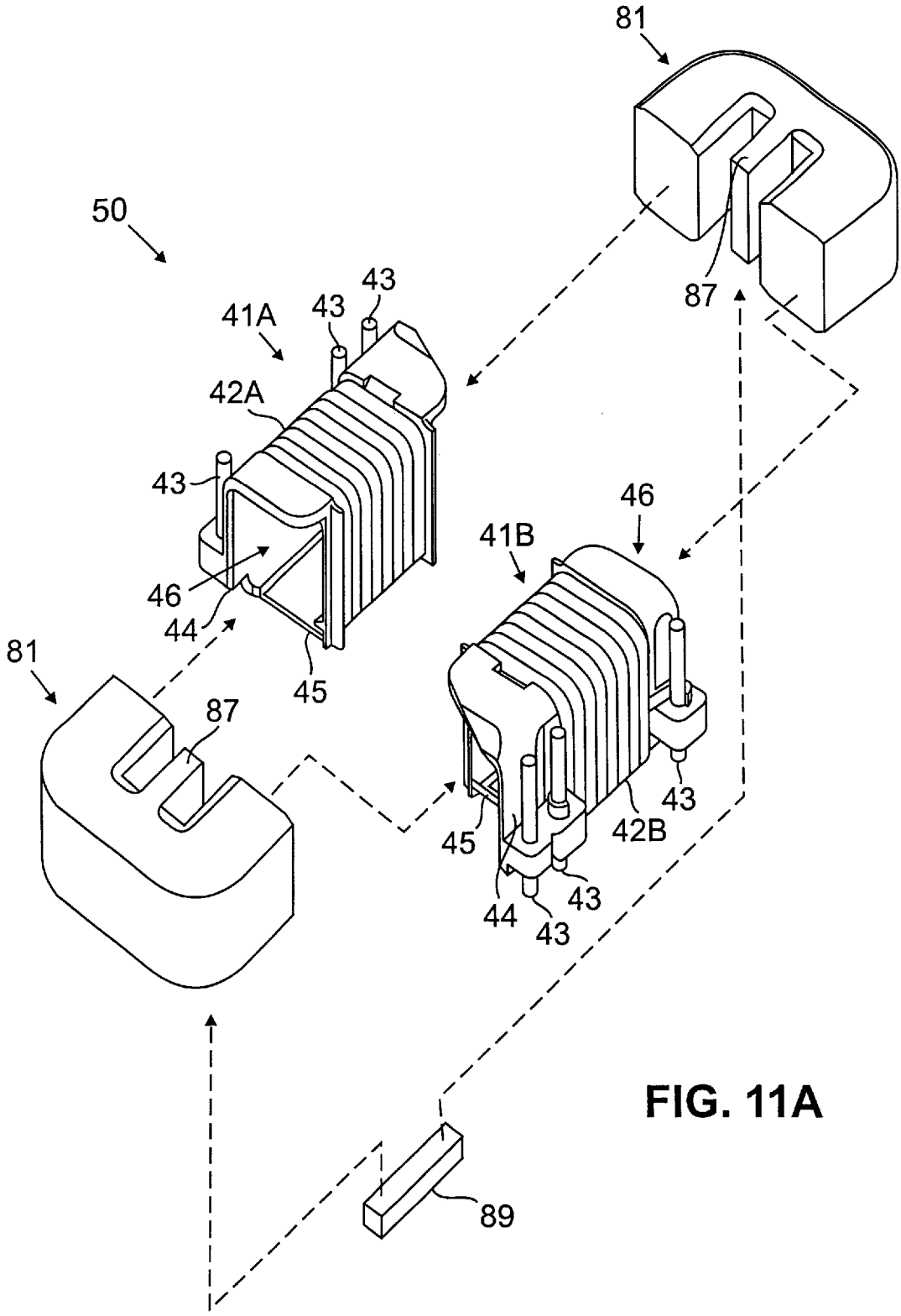
FIGS. 11A through 11C show transformers using saturable slugs.
Figure 11B:
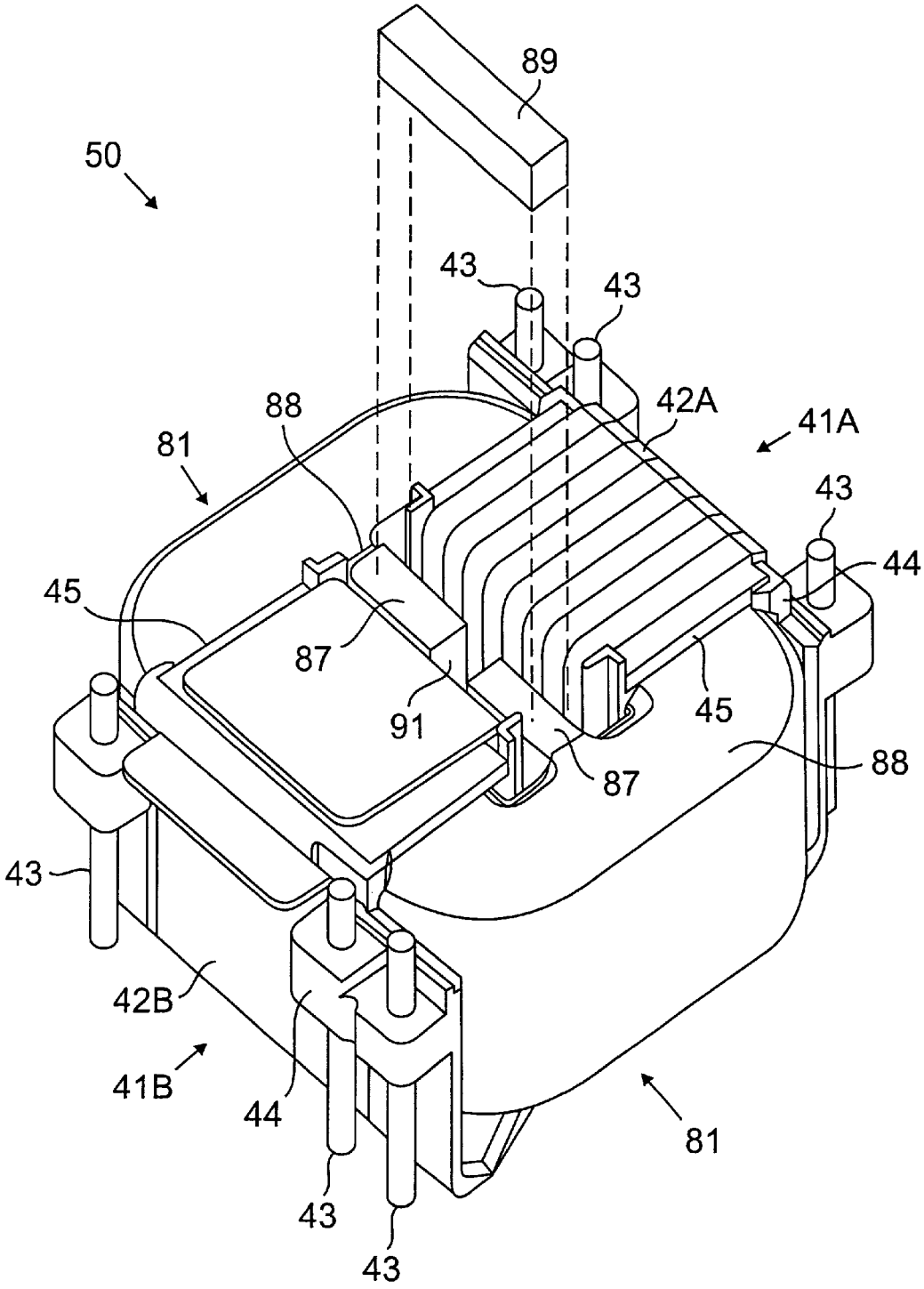

Another transformer 50 is shown in FIGS. 11A and 11B. All of the elements in the Figures are the same as those shown in FIG. 5, except that a winding 42B is shown installed on composite bobbin 41B (a multi-turn winding in FIG. 11A and a single turn winding in FIG. 11B); the core assemblies 81 are modified to include magnetically permeable "leakage lugs" 87; and a piece of saturable magnetic material (a "saturable slug" 89) is shown for use in bridging the region of the leakage gap 91 (FIG. 11B) formed between the leakage lugs 87. The slug may be attached by an adhesive or epoxy or it may be held in place mechanically (e.g., by a clip). The leakage lugs perform the same function as those shown in FIG. 2 and disclosed in the transformer patent: by providing a path for flux which does not couple both windings, the lugs increase the equivalent leakage inductance of the transformer 50 over that which would be present in a transformer without the lugs. A conductive medium, of the kind described above and in the transformer patent, for constraining the emanation of leakage flux, may also be present on the surfaces of the core assemblies 81 (including the surfaces of the leakage lugs 87), with appropriate provisions being made to avoid formation of shorted turns around the flux paths. In FIG. 11B, a conductive medium 88 is shown covering the surfaces of the ends of the core assemblies 81 (but not the leakage lugs 87).

Figure 3:
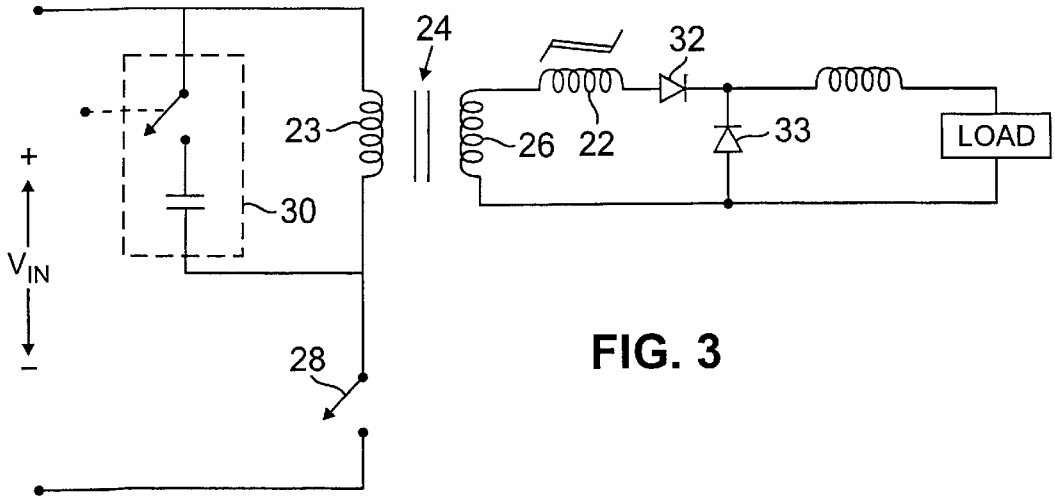
FIG. 3 shows a partial schematic view of a switching power supply.

The saturable slug 89 has a relatively high magnetic permeability up to a flux level corresponding to its saturation flux density. Above the saturation flux density the slug saturates and the equivalent permeability drops sharply. Thus, when a voltage is applied to the transformer, the saturable slug will initially appear as a low permeability path and will shunt substantial flux. This will be reflected as a relatively high equivalent value of leakage inductance. When the flux density in the slug rises to the saturation flux density the slug will no longer be effective as a path for incremental flux and the incremental reluctance of the magnetic path comprising the slug 89 and the lugs 87 will be essentially equal to the incremental reluctance of the lugs 87 and the leakage gap 91 alone. Thus, when the slug saturates, the equivalent leakage inductance of the transformer can be made to drop to a lower level (approximately equal to the leakage inductance of the transformer 50 without the slug 89). As a result, the slug can produce an effect which is similar to that of the discrete saturable inductor 22 shown in FIG. 3. However, while different discrete saturable inductors 22 having differing numbers of turns are required to provide the same "time to saturation" rating for transformer configurations having the same magnetic cores but different turns ratios, this is not the case when a saturable slug is used. If, for example, a family of transformers is designed for optimum core utilization (e.g., an essentially fixed "volts per turn" rating is factored into the selection of the windings so that an essentially constant peak flux density is achieved in each different transformer), then the flux in the path comprising the slug 89 and the lugs 87 will be approximately the same independent of the input voltage and turns ratio of the transformer. As a result, a given combination of core 81, saturable slug 89 and leakage gap 91 will produce saturable inductances having essentially the same "time to saturation" ratings irrespective of the turns ratio of the transformer, provided only that the volts-per-turn of the windings in different configurations are maintained approximately the same. Thus, a single configuration of core assemblies and slug can provide a wide variety of transformers, all of which will exhibit essentially the same "time to saturation." For a given size core and core material, and a given core plating pattern, the leakage inductance of the transformer before and after saturation can be set by varying the gap and the dimensions of the saturable slug.

Figure 1A:
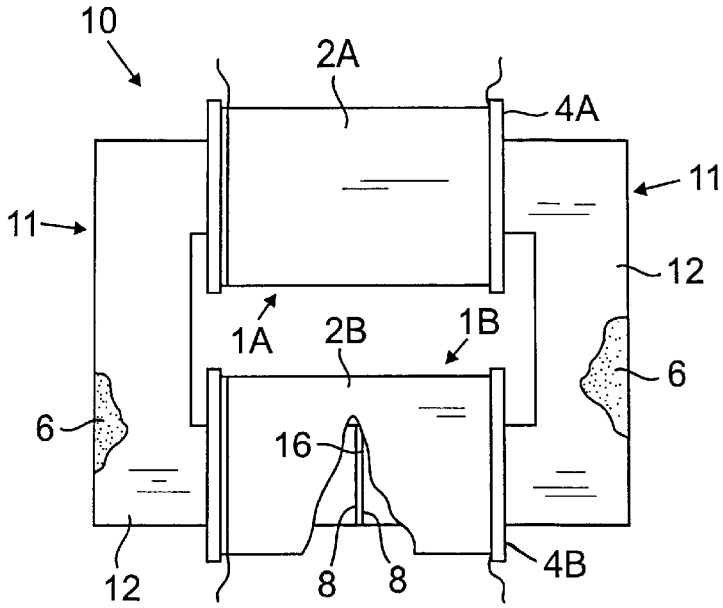
FIGS. 1A and 1B show, respectively, top and side views of a transformer.
Figure 1B:
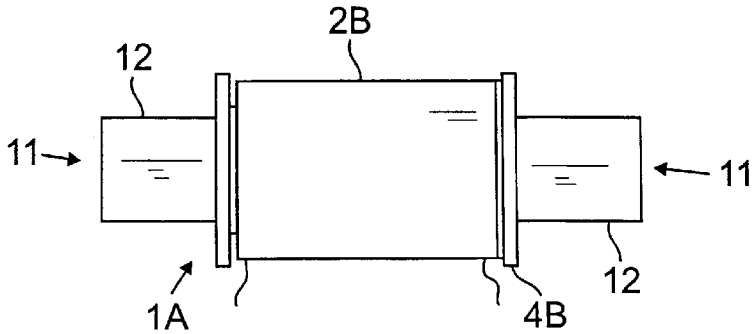
Figure 11C:
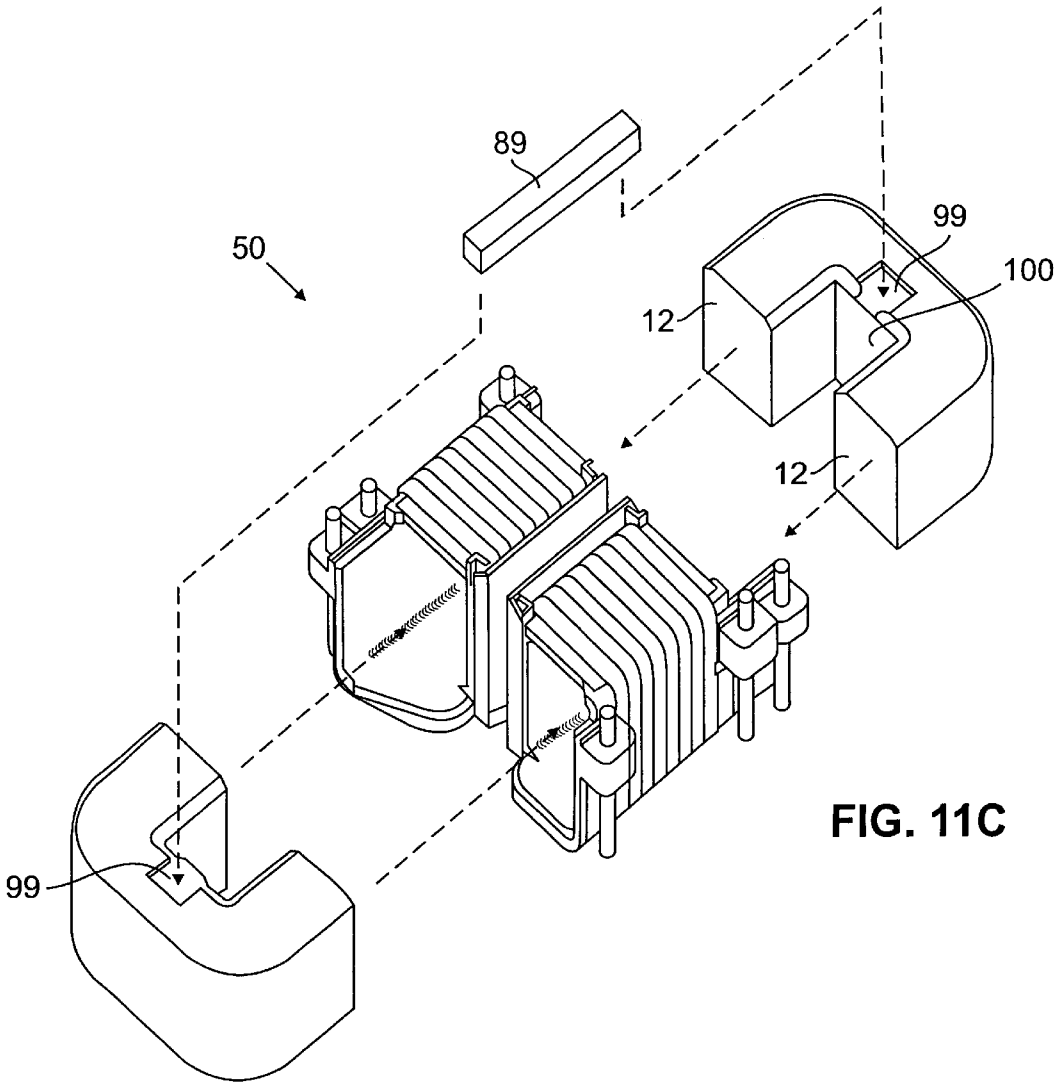

Transformers using leakage lugs (with or without slugs) are useful in applications in which a pre-determined and controlled amount of transformer leakage inductance is required (e.g., in zero-current switching power converters of the kind described in U.S. Pat. No. 4,441,146, "Optimal Resetting of the Transformer's Core in Single-Ended Forward Converter", Vinciarelli, assigned to the same assignee as this application, incorporated by reference). In certain applications, however, such as PWM power converters, it is desirable to minimize transformer leakage inductance. In such converters, a transformer might incorporate a conductive medium (e.g., medium 12, FIG. 1) over a substantial portion of the surface of the core pieces (as this will reduce leakage inductance) and leakage lugs would not be used (as their use would increase leakage inductance). The benefit of a saturable slug may be achieved in such a transformer by installing the slug between regions on the surfaces of the permeable cores which have been cleared of conductive medium. One example of such a transformer is shown in FIG. 11C. In the Figure, a saturable slug 89 is attached to the surface of the permeable cores at locations 99 which have been cleared of conductive medium 12. Another way of incorporating the slug 89 is to clear the conductive medium 12 from the inner faces 100 of the ends of the core pieces and install the slug between the cleared locations on the faces.

Transformers using saturable slugs may be constructed using the methods described above: a gap 56 between the core pieces can be set as a means of providing a desired value of magnetizing inductance and the composite bobbins may then be bonded to the core pieces to maintain the gap. A saturable slug may then be added to the transformer to provide the desired "time to saturation" characteristic.

Non-saturating material may also be used for the slug 89, to provide an essentially constant value of leakage inductance. This is useful where a range of values of leakage inductance need to be set.

Figure 11D:
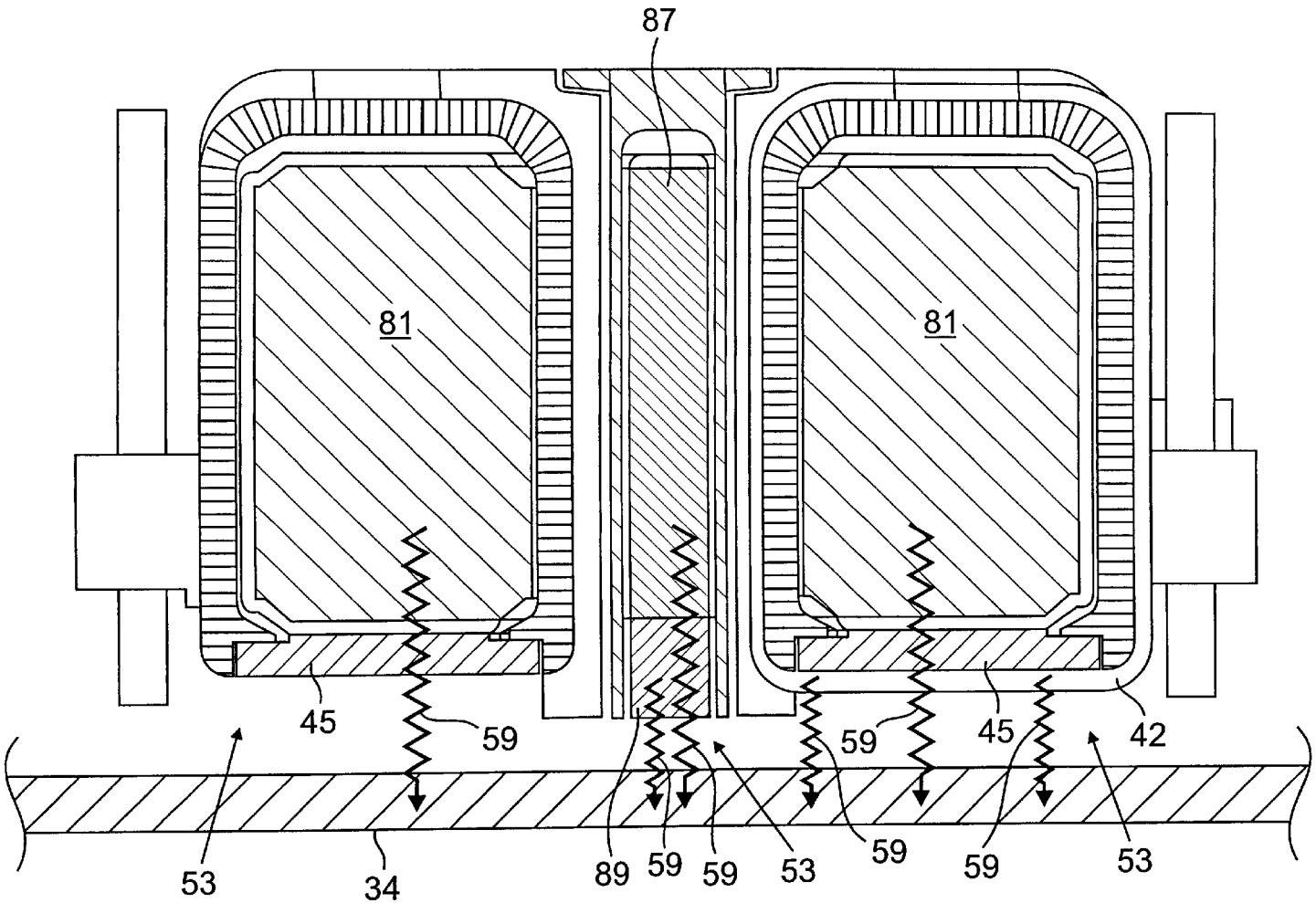
FIG. 11D shows a transformer with a saturable slug in proximity to a heat sinking surface.

The slug is easy to cool owing to its location on the outer surface of the transformer 50. As shown in FIG. 11D, by locating the slug 89 on the side of the transformer on which the conductive segments 45 are located, and placing the transformer in proximity to a heat sinking surface 34 (as shown, for example, in FIG. 8) with thermally conductive material (such as a silicone encapsulant) in the regions 53 between the transformer and the heat sink 34, heat from the saturable slug 89 can flow directly down into the heat sink. Transformers of the kind shown in FIGS. 11A through 11C are thermally optimal in an application like that shown in FIG. 11D because low thermal impedance paths 59 (FIG. 11D) exist between the heat sink 34 and the core assemblies 81; the heat sink and the windings (one winding 42 is shown in FIG. 11D); the heat sink and the saturable slug 89; and the heat sink and the leakage lugs 87.

Figure 12A:
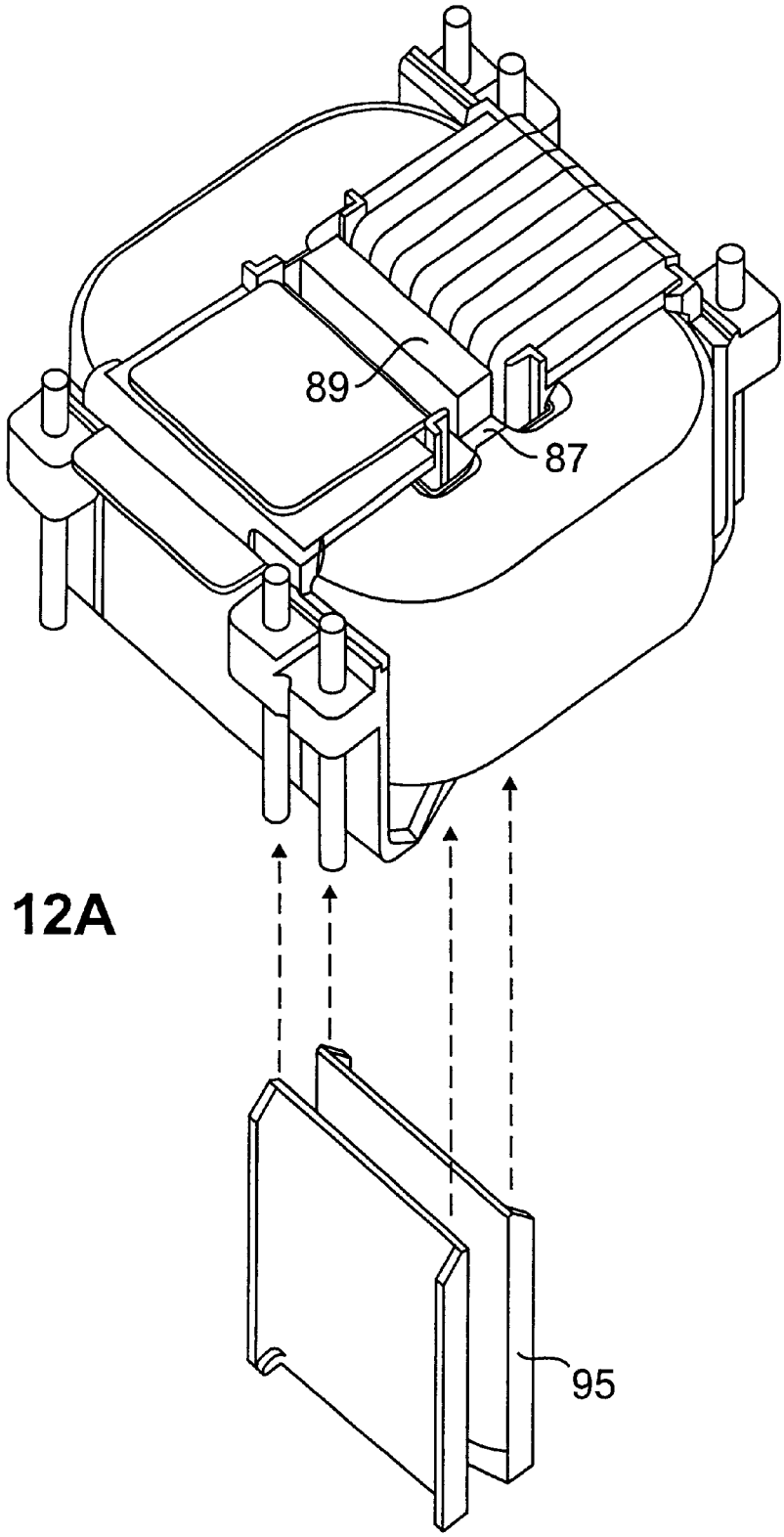
FIGS. 12A and 12B show a transformer with an insulating coupler.
Figure 12B:
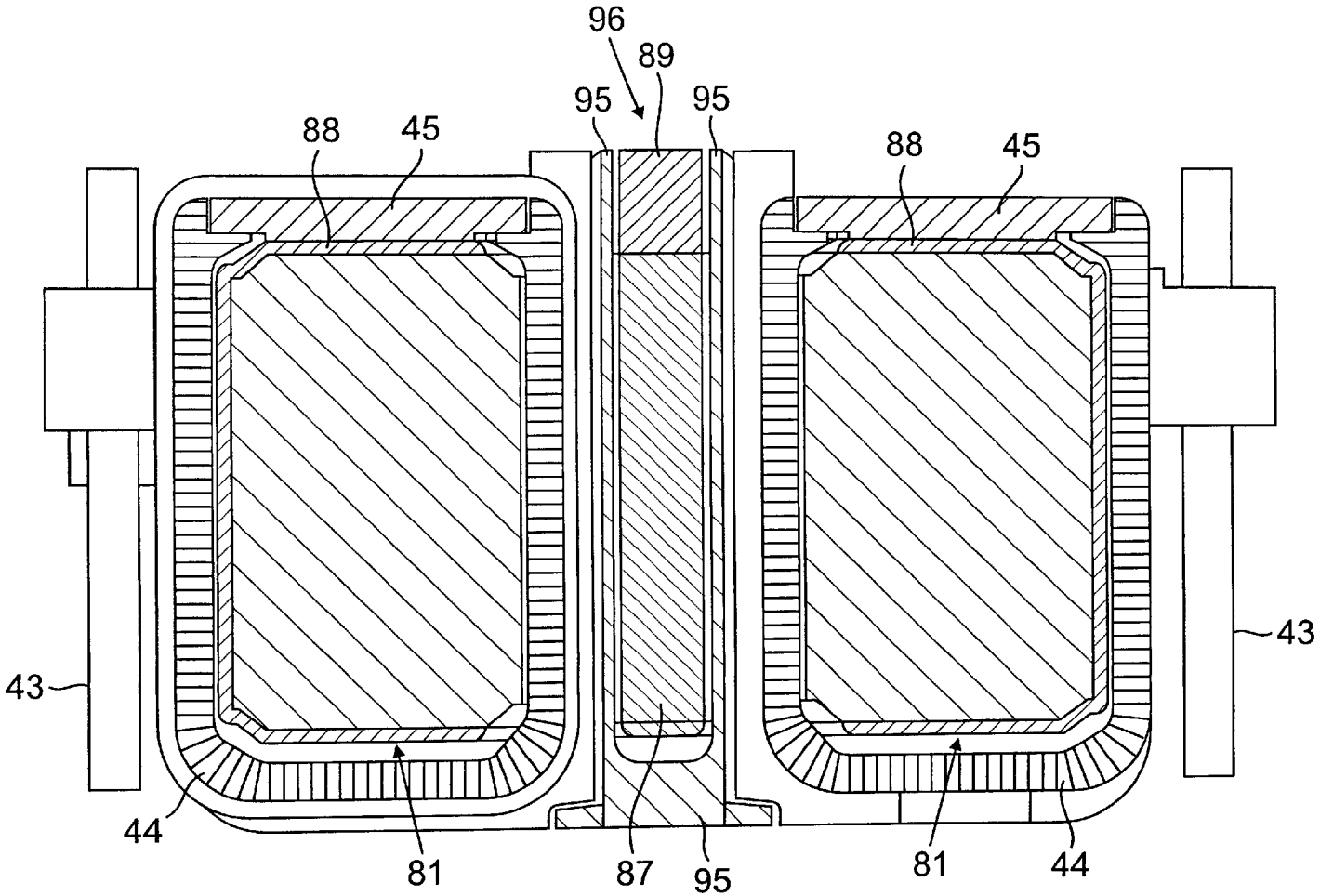

In some applications the presence of the leakage lugs 87 and the slug 89 in the region between the windings 42A, 42B may reduce the interwinding breakdown voltage rating. As shown in FIGS. 12A and 12B (which shows a section through the transformer in the region of the two bobbins), a U-shaped electrically insulating coupler 95 can be used to provide additional insulation. The coupler 95 fits over the leakage lugs 87 to provide additional interwinding insulation but leaves the slug 89 exposed in the region 96 at the bottom to allow for removal of heat as explained above.

Figure 11E:
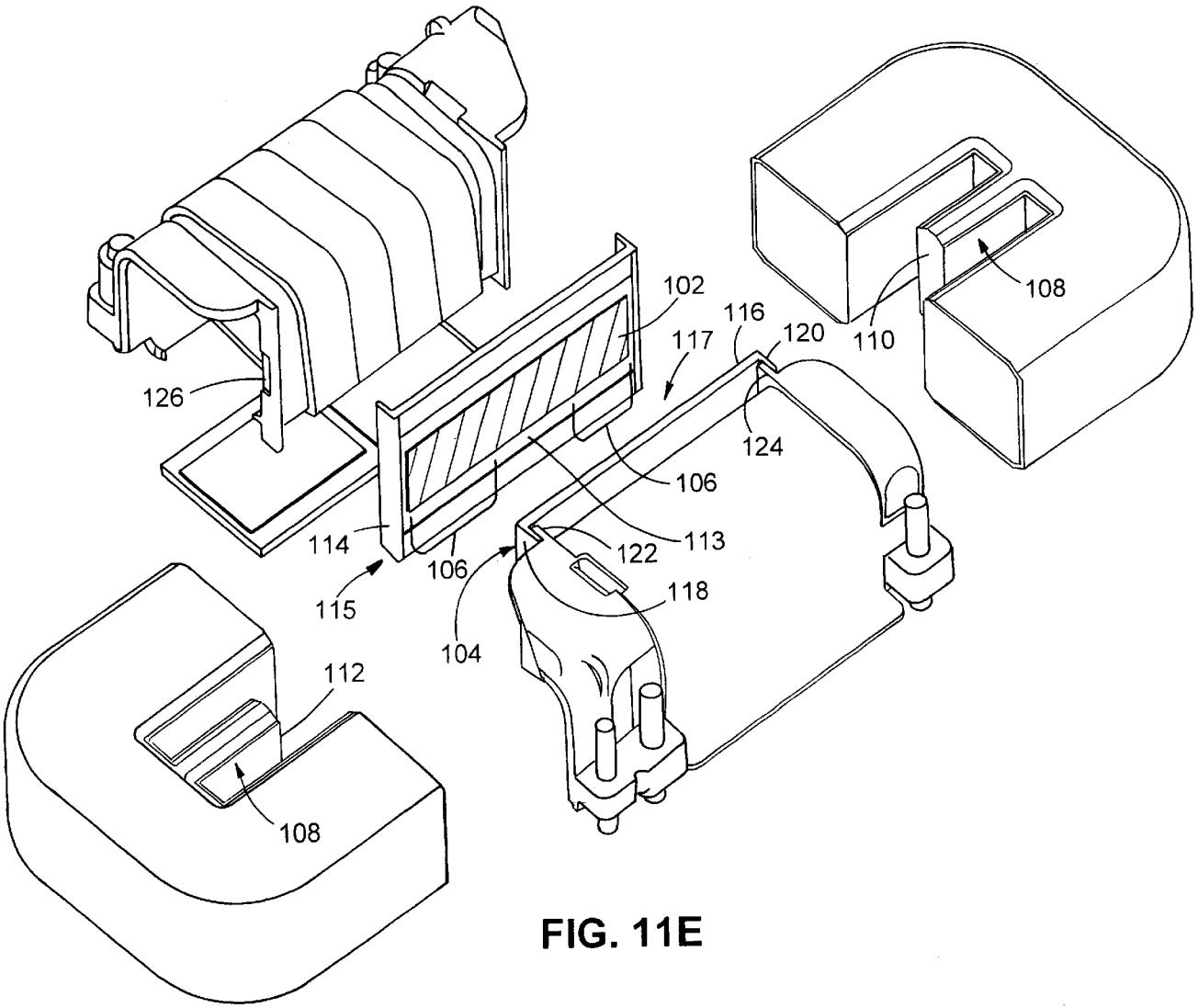
FIG. 11E shows a transformer with a saturable insert.

In another configuration, seen in FIG. 11E, saturable magnetic slug 89 is replaced by a pair of magnetically permeable rectangular inserts 102, 104 (104 hidden) in the form of strips of magnetic tape. The inserts are, for example, made of unannealed amorphous saturable magnetic material available, for example, as Metglas 2714A from Allied Signal, Inc., in thicknesses from 0.65 milli-inches to 0.95 milli-inches. When the transformer is assembled, an overlap region 106 at each end of each of the inserts contacts a corresponding side wall 108 of one of the lugs 110, 112, to provide a similar function to the slug 89 described earlier. The thickness and other dimensions of the inserts are chosen based upon the desired value of unsaturated inductance and the desired volt-second rating of the saturable insert. Thinner strips provide better high frequency performance.

Each insert 102, 104 is bonded (e.g., by epoxy or other adhesive) to a recessed area 113 of a corresponding plastic support 114, 116 to form assemblies 115, 117. Each support 114, 116 has a pair of end flanges 118, 120 that loosely snap into features (e.g., feature 126) on the bobbins. Once snapped in place the support pieces 114, 116 are located (e.g., by use of a wedge, not shown) so that the overlap regions 106 on the inserts 102, 104 are in contact with the side walls 108 of the lugs 100, 112. The support pieces are held in place with adhesive.

The assemblies 115, 117 are simple, cheap, and easy to make and install. The operating effect of the saturable strips is easy to adjust by changing their thickness, length, and/or width. The strips could be formed of non-saturable material for purposes described earlier for the slug 89. A single insert and support may be used instead of the pair depicted in FIG. 11E.

Unlike slug 89, the inserts 102, 104 do not generate a substantial amount of heat and do not have to be positioned next to a heat sink.

Other embodiments fall within the scope of the following claims. For example, the high thermal conductivity material may be aluminum nitride, boron nitride, silicon carbide, silicon nitride, beryllium oxide or zirconia. The low thermal conductivity segment of the bobbin may be fabricated from a thermal plastic (e.g., phenolic, bakelite) or a thermoplastic.

What is claimed is:

1. A leakage inductance transformer comprising a bobbin having a wall including an electrically insulating material surrounding an interior space, the wall having an interior surface forming a perimeter around the interior space, an external surface for supporting a winding, a first segment having a first thermal conductivity, and a second segment having a second thermal conductivity, the second thermal conductivity being lower than the first thermal conductivity, a winding on the external surface, a permeable magnetic core having a portion located within the interior space, and a permeable magnetic insert that is located outside of the interior space, wherein the wall separates the winding from the portion of the permeable core, and the first segment provides a thermally conductive path for conduction of heat from the core to a location outside the winding.

2. The transformer of claim 1 wherein said magnetic core comprises separable core pieces.

3. The transformer of claim 2 wherein the separable core pieces further comprise ends which are separated by a gap that lies within the hollow interior space.

4. The transformer of claim 1 wherein said permeable core comprises a conductive medium on a portion of its surface.

5. The transformer of claim 2 or 3 wherein said separable core pieces comprise a conductive medium on portions of their surfaces.

6. The transformer of claim 1 further comprising a bond between one of the segments and said permeable core.

7. The transformer of claim 2 or 3 further comprising a bond between one of the segments and said core pieces.

8. The transformer of claim 4 further comprising a bond between one of the segments and said permeable core.

9. The transformer of claim 5 further comprising a bond between one of the segments and said core pieces.

10. The transformer of claim 7 wherein said bond maintains the core pieces in a fixed relation to each other and maintains a gap between ends of the core pieces.

11. The transformer of claim 9 wherein said bond maintains the core pieces in a fixed relation to each other and maintains a gap between ends of the core pieces.

12. The transformer of claims 6 or 8 wherein said one segment has a thermal conductivity greater than 1 BTU/(hour×foot×deg.F)).

13. The transformer of claim 7 wherein said one segment has a thermal conductivity greater than 1 BTU/(hour×foot×deg.F)).

14. The transformer of claim 9 wherein said one segment has a thermal conductivity greater than 1 BTU/(hour×foot×deg.F)).

15. The transformer of claim 6 wherein a surface of said one segment comprises a metallic layer.

16. The transformer of claim 7 wherein a surface of said one segment comprises a metallic layer.

17. The transformer of claim 9 wherein a surface of said one segment comprises a metallic layer.

18. The transformer of claims 6 or 8 wherein said bond comprises epoxy.

19. The transformer of claim 8 wherein said bond comprises epoxy.

20. The transformer of claim 9 wherein said bond comprises epoxy.

21. The transformer of claim 8 wherein said bond comprises a solder connection to said conductive medium.

22. The transformer of claims 6 or 8 wherein said one segment comprises ceramic.

23. The transformer of claim 7 wherein said one segment comprises ceramic.

24. The transformer of claim 9 wherein said one segment comprises ceramic.

25. The transformer of claim 15 wherein said metallic layer comprises copper.

26. The transformer of claim 1 in which the permeable insert comprises a permeable magnetic strip.

27. The transformer of claim 26 further comprising a magnetically permeable leakage lug which is located outside of the interior space.

28. The transformer of claim 27 wherein said strip lies in a flux path defined by said leakage lug.

29. The transformer of claim 27 wherein said strip is permeably linked to said leakage lug.

30. The transformer of claim 27 or 29 wherein said insert comprises a saturable magnetic material.

31. The transformer of claim 30 wherein the insert comprises amorphous magnetic material.

32. The transformer of claim 30 wherein the strip lies in a plane perpendicular to the wall that provides the thermally conductive channel.

33. The transformer of claim 1 wherein the insert comprises a magnetically permeable slug.

34. The transformer of claim 1 further comprising a magnetically permeable leakage lug located outside of the hollow interior space enclosed by the bobbin, wherein a leakage flux path passes through the leakage lug and the insert.

35. The transformer of claim 34 wherein the insert comprises a magnetically permeable slug.

36. The transformer of claim 35 wherein the slug is permeably linked to the leakage lug.

37. The transformer of claim 33 or 35 wherein the insert comprises a saturable magnetic material.

38. The transformer of claim 35 wherein the slug is attached to a surface of the lug.

39. The transformer of claim 35 wherein the slug and the thermally conductive path are arranged so that when the thermally conductive path is connected to a heat sinking surface the slug is also connected to the heat sinking surface.

40. The transformer of claim 4 wherein the insert is attached to an area of the surface of the permeable core free of the conductive medium.

41. The transformer of claim 1 further comprising an electrically insulating coupler interposed between the insert and the winding to electrically insulate the winding.

42. The transformer of claim 27 wherein the strip comprises amorphous magnetic material.

43. The transformer of claim 27 wherein the strip overlaps a sidewall of the lug.

44. The component of claim 9 wherein said segment is attached to said conductive medium by means of solder.

45. The transformer of claim 16 wherein said metallic layer comprises copper.

46. The transformer of claim 17 wherein said metallic layer comprises copper.

* * * * *